US010266931B2

(12) United States Patent
Kang et al.

(10) Patent No.: US 10,266,931 B2
(45) Date of Patent: Apr. 23, 2019

(54) ALUMINUM ALLOY AND VEHICLE PART USING THE SAME

(71) Applicant: Hyundai Motor Company, Seoul (KR)

(72) Inventors: Hee Sam Kang, Seoul (KR); Eun Ji Hong, Seoul (KR)

(73) Assignee: Hyundai Motor Company, Seoul (KR)

( * ) Notice: Subject to any disclaimer, the term of this patent is extended or adjusted under 35 U.S.C. 154(b) by 308 days.

(21) Appl. No.: 14/328,006

(22) Filed: Jul. 10, 2014

(65) Prior Publication Data

US 2015/0167136 A1 Jun. 18, 2015

(30) Foreign Application Priority Data

Dec. 18, 2013 (KR) ..... 10-2013-0158795

(51) Int. Cl.
*C22C 21/08* (2006.01)
*C22F 1/047* (2006.01)

(52) U.S. Cl.
CPC ..... *C22F 1/047* (2013.01); *C22C 21/08* (2013.01)

(58) Field of Classification Search
CPC ..... C22F 1/047; C22C 1/08; C22C 21/08
See application file for complete search history.

(56) References Cited

FOREIGN PATENT DOCUMENTS

| | | | | |
|---|---|---|---|---|
| JP | 06145868 | | 5/1994 | |
| JP | 3684313 | B2 | 8/2005 | |
| JP | 2007100205 | A | 4/2007 | |
| JP | 2011080118 | A | 4/2011 | |
| JP | 5430022 | B2 | 2/2014 | |
| KR | 10-2008-0102560 | A | 11/2008 | |
| KR | 10-2012-0057402 | | 6/2012 | |
| WO | WO-2011090451 | A1 * | 7/2011 | ..... C22C 21/08 |

OTHER PUBLICATIONS

Kosuge et al., English machine translation of JP 2011-080118, Apr. 21, 2011, p. 1-17.*
Seong et al., English machine translation of KR 2012-0057402, Jun. 5, 2012, p. 1-14.*
Jeon et al., KR 20120057402 A and its English machine translation (Year: 2012).*

* cited by examiner

*Primary Examiner* — Jessee R Roe
*Assistant Examiner* — Jophy S. Koshy
(74) *Attorney, Agent, or Firm* — Mintz Levin Cohn Ferris Glovsky and Popeo, P.C.; Peter F. Corless

(57) ABSTRACT

An aluminum alloy is provided that includes magnesium (Mg) of about 8.0 wt % to 10.5 wt %, silicon (Si) of about 1.9 wt % to 3.4 wt %, copper (Cu) of about 0.4 wt % to 2.0 wt %, and a balance of Al. In addition, a vehicle part is manufactured using the same aluminum alloy.

3 Claims, 3 Drawing Sheets

ALUMINUM ALLOY AND VEHICLE PART USING THE SAME

CROSS REFERENCE TO RELATED APPLICATION

This application claims the benefit of Korean Patent Application No. 10-2013-0158795, filed on Dec. 18, 2013, entitled "Aluminum alloy and vehicle part using the same", which is hereby incorporated by reference in its entirety into this application.

TECHNICAL FIELD

The present invention relates to a method of preparing a high-strength and high-corrosion resistance light aluminum alloy which does not generate white rust on aluminum parts of vehicles, and more particularly, to a high-strength and high-corrosion resistance aluminum-magnesium-silicon-copper (Al—Mg—Si—Cu)-based aluminum alloy and a vehicle part using the aluminum alloy.

BACKGROUND

The present invention relates to a high-strength and high-corrosion resistance aluminum alloy which can be used for aluminum parts of vehicles, and more particularly to a high-strength and high-corrosion resistance Al—Mg—Si—Cu-based aluminum alloy having benefits over a conventional Al—Si—Cu-based alloy for die casting (hereafter, referred to as ADC10/12). The ADC10/12 alloy has been used for the die casting parts of vehicles and is still widely used because of low cost and good casting ability. However, as the environmental conditions for driving vehicles have become severe, limits of the ADC10/12 have been identified. Therefore, there has been a need for a new alloy material that can compensate for such limits, for example, damage on the parts of vehicles by lack of durability which has not been found in the parts previously, and white rust due to the salts in seawater or deicers.

Further, many countries including developed countries have made efforts to suppress environmental pollution by enforcing various environmental regulations. According to such enforced regulation, many studies for reducing the weight of the vehicle parts have been conducted to improve fuel efficiency in the vehicle industry, but the vehicle manufacturers have engaged in difficulties in finding an alternative alloy material which maintains basic performance while providing competitive pricing to replace the existing commercial alloys.

The description provided above as a related art of the present invention is merely for helping understanding the background of the present invention and should not be construed as being included in the related art known by those skilled in the art.

SUMMARY OF THE INVENTION

The present invention provides a method of preparing a light-weight aluminum alloy having high-strength and high-corrosion resistance which does not generate white rust on aluminum parts of vehicles. In particular, the present invention provides an Al—Mg—Si—Cu-based aluminum alloy having a high-strength and high-corrosion resistance, and a vehicle part manufactured using the alloy.

In one exemplary embodiment of the present invention, an aluminum alloy may contain magnesium (Mg) of about 8.0 wt % to 10.5 wt %, silicon (Si) of about 1.9 wt % to 3.4 wt %, copper (Cu) of about 0.4 wt % to 2.0 wt %, and a balance of aluminum (Al). The ratio of Mg to Si in the aluminum alloy may be from about 3.1 to about 4.3. The aluminum alloy may include primary crystal particles of magnesium silicide ($Mg_2Si$) in the structure. The size of the primary crystal particles of $Mg_2Si$ may be from about 2 μm to about 30 μm. The aluminum alloy may include Al—Cu—Mg-based intermetallic compound particles in the structure. The aluminum alloy may include both primary crystal particles of magnesium silicide ($Mg_2Si$) and Al—Cu—Mg-based intermetallic compound particles in the structure.

In another exemplary embodiment of the present invention, a vehicle part may be manufactured by casting and performing heat treatment using the aluminum alloy having the composition described above. The heat treatment may be performed at a temperature between about 200° C. and about 250° C. for a time period between about 1.5 hours and about 4.5 hours.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION

Figure 1:
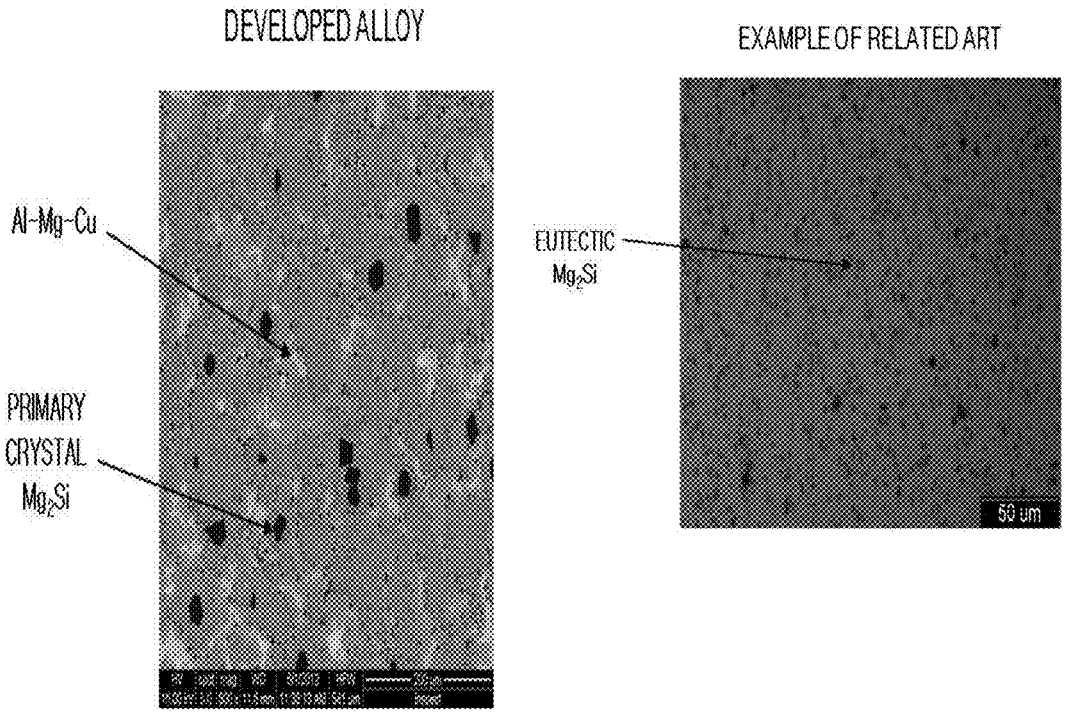
FIG. 1 shows exemplary microscopic views of the microstructures of an aluminum alloy according to one exemplary embodiment of the present invention (left, DEVELOPED ALLOY) and a pseudobinary eutectic alloy of related art (right, EXAMPLE OF RELATED ART)

Hereinafter, an exemplary embodiment of the present invention will be described in detail. However, the exemplary embodiment is illustrative only but is not to be construed to limit the present invention, and the present invention is just defined by the scope of the claims as described below.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum). As referred to herein, a hybrid vehicle is a vehicle that has two or more sources of power, for example both gasoline-powered and electric-powered vehicles.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

Exemplary embodiments of the present invention are described hereafter with reference to the accompanying drawings. The present invention relates to a method of preparing a high-strength and high-corrosion resistance light aluminum alloy which prevents the generation of white rust on aluminum parts of vehicles, and a high-strength and high-corrosion resistance Al—Mg—Si—Cu-based alloy.

In one exemplary embodiment of the present invention, an aluminum alloy may include aluminum (Al) as the main component, magnesium (Mg) of about 8.0 wt % to 10.5 wt %, silicon (Si) of about 1.9 wt % to 3.4 wt %, and copper (Cu) of about 0.4 wt % to 2.0 wt %. In addition, the ratio of Mg to Si may be from about 3.1 to about 4.3 for production and appropriate distribution of an Al—Mg—Cu-based intermetallic compound. Thus, high strength and high corrosion resistance of the aluminum alloy can be ensured. The aluminum alloy may contain Mg of about 8.0 wt % to 10.5 wt %, Si of about 1.9 wt % to 3.4 wt %, Cu of about 0.4 wt % to 2.0 wt %, and a balance of Al. The ratio of Mg to Si may be from about 3.1 to about 4.3. The aluminum alloy may include primary crystal particles of $Mg_2Si$ in the structure. The size of the primary crystal particles of $Mg_2Si$ may be from about 2 μm to about 30 μm.

In another exemplary embodiment of the present invention, a vehicle part is manufactured by casting and performing heat treatment using the aluminum alloy having the composition above. The heat treatment may be performed at a temperature between about 200° C. and about 250° C. for a time period between about 1.5 hours and about 4.5 hours.

The present invention also provides the aluminum alloy which may include Al as the main component, Mg of about 8.0 wt % to 10.5 wt %, Si of about 1.9 wt % to 3.4 wt %, and Cu of about 0.4 wt % to 2.0 wt % for production and appropriate distribution of an Al—Mg—Cu-based intermetallic compound for ensuring high strength/high corrosion resistance. Therefore, such properties, for example, light weight (e.g., reduced weight), high strength, and high corrosion resistance, may be obtained advantageously over the existing ADC10/12 alloy for die casing.

Some related arts have reported a method of obtaining a pseudobinary eutectic structure of Al—$Mg_2Si$ by suppressing production of an intermetallic compound, limiting the ratio of Mg to Si to from 1.98 to 2.5 for achieving a microstructure structure, and performing an ultrasonic treatment, even by adding of Mg, Si, and Cu. However, for such alloy of the pseudobinary eutectic structure of Al—$Mg_2Si$ or of greater content of the Al—$Mg_2Si$, more processing conditions are required for achieving a desired pseudobinary eutectic structure and thus the quality deviation increases.

Accordingly, the present invention provides the aluminum alloy that may be used in common casting and further may have improved strength, lower density, and greater corrosion resistance than those of the existing common alloys. The aluminum alloy may be obtained by implementing a composite microstructure with a substantial amount of the Al—Mg—Cu-based intermetallic compound and primary crystal particles of $Mg_2Si$ by optimizing the ratio of Mg to Si.

FIG. 1 shows exemplary microscopic images in comparison of the microstructures of an alloy prepared according to one exemplary embodiment of the present invention (left) and the pseudobinary eutectic structure of the related art (right). As shown in FIG. 1, the aluminum alloy of the present invention has the composite microstructure which may include Al—Mg—Cu-based (white) intermetallic compounds as of the main reinforcing phases and primary crystal particles of $Mg_2Si$ (black) having a size from about 2 μm to about 30 μm. Meanwhile, the eutectic $Mg_2Si$ particles in the pseudobinary eutectic structure are finely distributed in an Al matrix.

In one exemplary embodiment, the present invention provides the aluminum alloy which may include Al as the main component, Mg of about 8.0 wt % to about 10.5 wt %, Si of about 1.9 wt % to about 3.4 wt % and Cu of about 0.4 wt % to about 2.0 wt %. Mg in the alloy may be one of the most important elements, which may determined high strength (e.g., improved), high corrosion resistance (e.g., improved), and low (e.g., reduced) density that are main properties of the alloy. In addition, the amount of Mg may be from about 8.0 wt % to about 10.5 wt %. When the amount of Mg is 8.0 wt % or less, a desired level of Al—Mg—Cu-based intermetallic compound may not be obtained although Si is added, due to lack of a producible amount of the Al—Mg—Cu-based intermetallic compound. Accordingly, since the amount of the Al—Mg—Cu-based intermetallic compound that determines high strength and high corrosion resistance reduces, such desired properties may not be achieved. When the amount of Mg is 10.5 wt % or greater, casting ability and mechanical properties are deteriorated due to an increase in the particle size of the Al—Mg—Cu-based intermetallic compound and generation of hot cracks. Thus, the amount of Mg may be from about 8.0 wt % to about 10.5 wt %.

In the respect of Si amount, when the amount of Si is 1.9 wt % or less, the casting ability may not be improved sufficiently. Meanwhile, when the amount of Si is 3.4 wt % or greater, $Mg_2Si$ particles may be overly produced instead of the Al—Mg—Cu-based intermetallic compound which is the main reinforcing particle. As a result, corrosion resistance and strength may be decreased. Accordingly, to achieve the optimum high strength and high corrosion resistance, adjustment of the amount of Si in accordance with the content of Mg is required and the ratio of Mg to Si may be in a range from about 3.1 to about 4.3.

Cu may produce the Al—Mg—Cu-based intermetallic compound, which is the reinforcing phase, when associated with Mg. When the amount of Cu is 0.4 wt % or less, reinforcing effect may be insufficient. When the amount of Cu is 2.0 wt % or greater, other intermetallic compound that causes galvanic corrosion with the Al matrix may be generated, resulting in decreased corrosion resistance of the alloy.

The Inventive Examples and Comparison Examples containing various amounts of Mg were tested and each produced amount of the Al—Mg—Cu-based intermetallic compound is shown in Table 1.

TABLE 1

| Item | Al | Mg (wt %) | Si (wt %) | Cu (wt %) | Produced amount of Al—Mg—Cu-based intermetallic compound (wt %) |
|---|---|---|---|---|---|
| Comparison Example | Remaining Portion | 7.5 | 3 | 0.9 | 4.0 |
| Comparison Example | Remaining Portion | 8.0 | 3 | 0.9 | 5.0 |
| Inventive Example | Remaining Portion | 8.5 | 3 | 0.9 | 7.0 |
| | Remaining Portion | 9.0 | 3 | 0.9 | 8.0 |
| | Remaining Portion | 9.5 | 3 | 0.9 | 9.5 |
| | Remaining Portion | 10.0 | 3 | 0.9 | 10.5 |
| | Remaining Portion | 10.5 | 3 | 0.9 | 12.0 |

Figure 2:
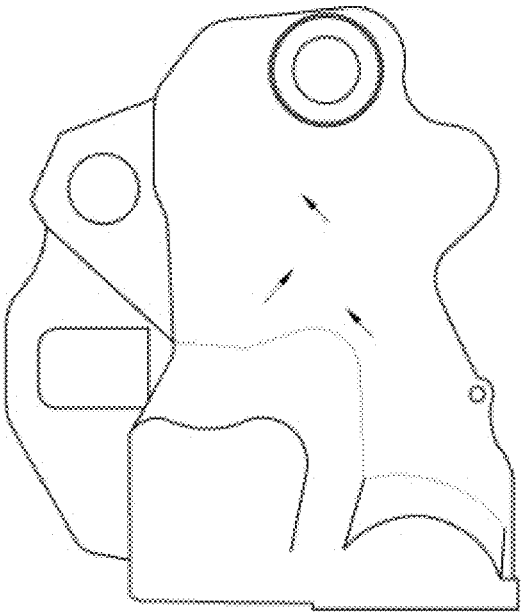
FIG. 2 is an exemplary schematic illustration showing an example of forming hot cracks.

Table 1 shows changes in the produced amounts of the Al—Mg—Cu-based intermetallic compound in the Al—Mg—Si-based alloy according to Mg content in the alloy composition. From Table 1, a sufficient amount of intermetallic compound is produced, when Mg of 8.0 wt % or greater is added, and the amount of the intermetallic compound generally increases as the Mg content increases. However, when a substantial amount of Mg of 10.5 wt % or greater is added, as shown in FIG. 2, hot cracks may be generated and likely to cause the defective proportion to increase in casting.

Other Inventive Examples and Comparison Examples containing various amounts of Cu were tested and mechanical properties of the Al—10Mg—3Si-based alloy were measured as shown in Table 2, to see the property of high strength of the Al—Mg—Si—Cu-based alloy of the present invention.

TABLE 2

| Item | Al | Mg (wt %) | Si (wt %) | Cu (wt %) | Tensile strength (MPa) | Yield strength (MPa) |
|---|---|---|---|---|---|---|
| Comparison Example | Remaining Portion | 10 | 3 | 0.3 | 280 | 160 |
| Inventive Example | Remaining Portion | 10 | 3 | 0.4 | 310 | 175 |
| | Remaining Portion | 10 | 3 | 0.5 | 325 | 185 |
| | Remaining Portion | 10 | 3 | 0.7 | 325 | 210 |
| | Remaining Portion | 10 | 3 | 0.9 | 335 | 220 |

Figure 3:
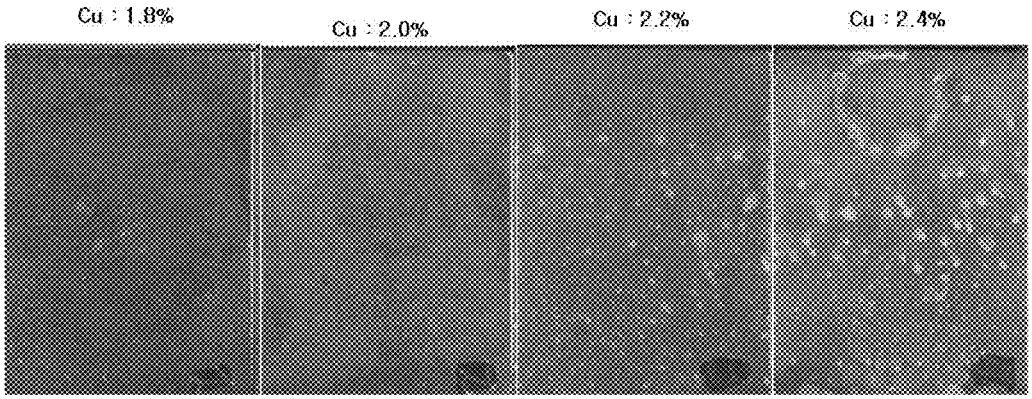
FIG. 3 shows exemplary photographic images indicating reductions of corrosion resistance due to galvanic corrosion according to changes in copper (Cu) content.

Table 2 shows changes in mechanical properties of the Al—10Mg—3Si-based alloy according to Cu content in the alloy composition. From Table 2, the mechanical properties, e.g. tensile strength or yield strength, of the Al—Mg—Si-based alloy increase as the Cu content increases, and thus, Cu content of about 0.4 wt % or greater may be added to achieve high strength of desired 300 MPa or greater. Like Mg, the mechanical properties may be generally improved as the content of Cu increases. However, when the amount of Cu exceeds 2.0 wt %, the corrosion resistance may be decreased due to galvanic corrosion, as shown in FIG. 3. Thus, the amount of Cu may be in a range of about 0.4 wt % to about 2.0 wt %.

As set forth above, durability of the aluminum alloy of one exemplary embodiment of the present invention may be improved by about 40% or greater from that of the related art. Furthermore, white rust shown in various aluminum parts may be eliminated by developing such a new high-strength/high-corrosion resistance aluminum alloy. Additionally, the weight of the aluminum alloy may be reduced by approximately 7% from the conventional alloy of the related art in about the same shape by reducing density. Thus, the present invention is noteworthy in reducing the weight and cost for various aluminum die casting parts and improving durability.

Although the present invention was described with reference to exemplary embodiments shown in the drawings, it is apparent to those skilled in the art that the present invention may be changed and modified in various ways without departing from the scope of the present invention, which is described in the following claims.

What is claimed is:

1. An aluminum alloy comprising:

magnesium (Mg) of 9.5 wt % to 10.5 wt %;

silicon (Si) of 1.9 wt % to 3.4 wt %;

copper (Cu) of 0.4 wt % to 2.0 wt %; and a balance of aluminum (Al), wherein a ratio of Mg to Si is from 3.1 to 4.3, wherein the aluminum alloy has a structure including both primary crystal particles of $Mg_2Si$ and Al—Cu—Mg-based intermetallic compound particles, wherein the aluminum alloy has produced amount of Al—Mg—Cu-based intermetallic compound of 9.5 wt % to 12.0 wt %, wherein the aluminum alloy has tensile strength of 310 MPa to 335 MPa, and wherein the aluminum alloy has yield strength of 175 MPa to 220 MPa.

2. A vehicle part manufactured by casting and performing heat treatment using the aluminum alloy of claim 1, wherein the aluminum alloy has a structure including both primary crystal particles of $Mg_2Si$ and Al—Cu—Mg-based intermetallic compound particles.

3. The vehicle part of claim 2, wherein the heat treatment is performed at a temperature between about 200° C. and about 250° C. for a time period between about 1.5 hours and about 4.5 hours.

* * * * *